US007796910B2

(12) United States Patent
Ueda et al.

(10) Patent No.: US 7,796,910 B2
(45) Date of Patent: Sep. 14, 2010

(54) IMAGE FORMING APPARATUS WITH CONTROLLING DEVICE FOR SUSPENDED PRINT JOB

(75) Inventors: Hiroki Ueda, Tokyo (JP); Tomoo Kudo, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 12/124,105

(22) Filed: May 20, 2008

(65) Prior Publication Data

US 2008/0219691 A1 Sep. 11, 2008

Related U.S. Application Data

(62) Division of application No. 11/228,798, filed on Sep. 16, 2005, now abandoned.

(30) Foreign Application Priority Data

Dec. 10, 2004 (JP) ..... 2004-358413

(51) Int. Cl.
*G03G 15/00* (2006.01)

(52) U.S. Cl. ..... 399/82; 399/83; 399/19

(58) Field of Classification Search ..... 399/82, 399/83, 19, 391, 393, 16, 21, 23, 27
See application file for complete search history.

(56) References Cited

U.S. PATENT DOCUMENTS 5,358,238 A * 10/1994 Mandel et al.
2001/0046065 A1* 11/2001 Furukawa et al.
2002/0063881 A1* 5/2002 Nakata et al.
2002/0135792 A1* 9/2002 Sommer et al.

* cited by examiner

*Primary Examiner*—David M Gray
*Assistant Examiner*—Laura K Roth
(74) *Attorney, Agent, or Firm*—Squire, Sanders & Dempsey L.L.P.

(57) ABSTRACT

In an image forming apparatus 1 capable of reserving a plurality of printing jobs, the suspended state retention time for retaining the suspended state is preset by the operation of an operation section 142. When a printing job during output operation has been suspended, a timing section 17 starts to measure the preset suspended state retention time. If the printing job having been suspended is not resumed even after the lapse of the suspended state retention time and there is a subsequent printable job, the order of the printing jobs is changed and the subsequent printing job is executed.

1 Claim, 5 Drawing Sheets

IMAGE FORMING APPARATUS WITH CONTROLLING DEVICE FOR SUSPENDED PRINT JOB

This application is based on Japanese Patent Application No. 2004-358413 filed on Dec. 10, 2004 in Japanese Patent Office, the entire content of which is hereby incorporated by reference.

BACKGROUND OF THE INVENTION

The present invention relates to an image forming apparatus capable of reserving a plurality of printing jobs.

In recent years, an image forming apparatus with a reserved copying function has been commercialized. The reserved copying function is utilized as follows. Function setting for a subsequent printing job is conducted by using the operation section of the image forming apparatus and a document of the subsequent printing job is read with a scanner. After completion of the printing job presently under execution, automatic execution of the subsequent printing job is carried out.

For such an image forming apparatus, proposals have been made regarding techniques capable of registration of a plurality of reserved copying operations, rearrangement of the executing order of the reserved copying operations, cancellation of reserved copying, and change of copying conditions of the reserved copying operation. Such proposals includes an image forming apparatus having a function of checking the presence of a sheet to be used for the printing job of subsequent execution after completion of the printing job presently under execution, a function of checking the presence of other printing jobs that can be executed when there are no sheets to be used for the aforementioned subsequent printing job and a function of changing the executing order of the reserved jobs when there is another printing job which can print (Japanese Unexamined Patent Publication No. 2000-312271 and Japanese Unexamined Patent Publication 2001-203851)

In an image forming apparatus having a prior art reserved copying function, when the printing job during output operation has been suspended for some reason (e.g., absence of paper, mismatching of paper size), and any command for restarting the suspended printing job is not given through the operation section, the apparatus automatically checks the subsequent printing jobs to ensure if there is any job that can be executed. If there is any, the apparatus changes the job order and executes the job. That is, the apparatus automatically proceeds to and executes the next job that can be executed.

In the prior art image forming apparatus, however, even if a user wishes to restart immediately the job having been suspended, a subsequent job may be started against the user's intention. Further, if the next job that is executable is large in volume, the user may have to wait for a long time before that job comes to an end.

There thus exists a need to improve the efficiency of printing with a plurality of reserved printing jobs in an image forming apparatus having a reserved copying function and to enable the apparatus to execute jobs in consideration of user's intention.

SUMMARY OF THE INVENTION

The present invention provides an image forming apparatus, capable of reserving a plurality of printing jobs, including a setting device to set suspended state retention time for retaining the suspended state of the printing job, a timing device to measure the suspended state retention time set by the aforementioned setting device when a printing job has been suspended during output operation, a control device wherein, if the printing job having been suspended cannot be restarted within the aforementioned suspended state retention time and there is a subsequently executable printing job, control is provided in such a way as to change the order of executing the printing jobs and to execute the subsequently executable job.

The invention itself, together with further objects and attendant advantages, will best be understood by reference to the following detailed description taken in conjunction with the accompanying drawings.

DETAILED DESCRIPTION OF THE PREFERRED EMBODIMENT

Figure 1:
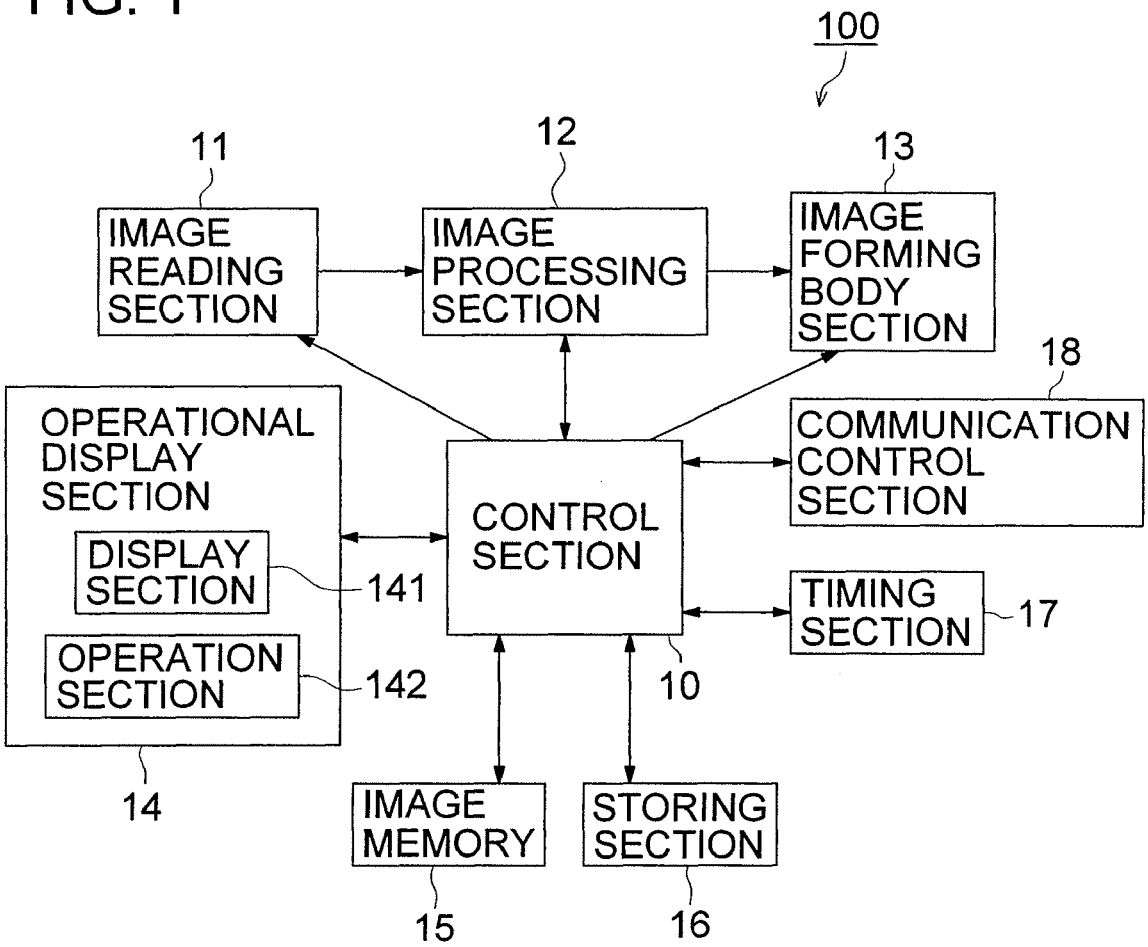
FIG. 1 is a block diagram showing the structure of the major portions of the image forming apparatus as Embodiments 1 and 2 of the present invention.

Referring to the drawings, the following describes the details of the embodiments of the present invention.

The structure of the present embodiment will be described first.

Embodiment 1

Embodiment 1 of the present invention will be described with reference to FIGS. 1 through 3:

FIG. 1 shows the structure of the major portions of the image forming apparatus as Embodiment 1 of the present invention. As shown in FIG. 1, the image forming apparatus 1 has a control section 10, an image reading section 11, an image processing section 12, an image forming body section 13, an operational display section 14, an image memory 15, a storing section 16 and a timing section 17.

The control section 10 is composed of a CPU (Central Processor Unit) and others, and controls the operations of the sections constituting the image forming apparatus 1, according to varieties of programs stored in the storing section 16.

When the printing job has been suspended during output operation for some reason in the image forming body section 13, the control section 10 allows the timing section 17 to start measuring the suspended state retention time (time for retaining the suspended state of the printing job) previously set by the user. If the printing job having been suspended is not restarted after the lapse of the suspended state retention time, and there is a reserved printing job other than the printing job having been suspended, then the printing jobs are replaced, and the subsequent printing job is executed (FIG. 3).

The image reading section 11 is provided with a scanner and others. The document image information is scanned by the scanner so that digital image signals (image data) are generated. The image processing section 12 applies various forms of image processing such as enlargement, reduction and rotation to the data scanned by the image reading section 11, according to the control signals inputted from the control section 10.

The image forming body section 13 is provided with an LD (Laser Diode), photosensitive drum, development section, transfer section, fixing section, sheet supply section, ejection section and others. It controls the drive of the LD based on the image data processed by the image processing section 12, according to the control signals from the control section 10, whereby electrostatic latent image is formed on the surface of the photosensitive drum. Further, the image forming body section 13 allows toner to be attached to an area including the electrostatic latent image on the surface of the photosensitive drum. After the toner has been transferred onto the printing sheet (transfer sheet) fed from the sheet supply section and has been fixed, the sheet is ejected from the ejection section.

The operational display section 14 has a display section 141 and an operation section 142. The display section 141 has a display screen such as an LCD (Liquid Crystal Display), and applies the required display processing according to the display control signals inputted from the control section 10.

The operation section 142 has various keys such as a copy start key and numeric keys, and allows the operation signals of these keys to be outputted to the control section 10. The operation section 142 has a touch panel arranged to cover the display surface of the display section 141. It detects the coordinates specified by a touch according to the coordinate reading principle based on electromagnetic inductive, magnetostrictive or pressure sensitive method. The detected coordinates are outputted as position signals to the control section 10. Various parameters, such as suspended state retention time, required for the operation of the image forming apparatus 1 are set on the storing section 16 by the operation of the operation section 142.

Figure 2:
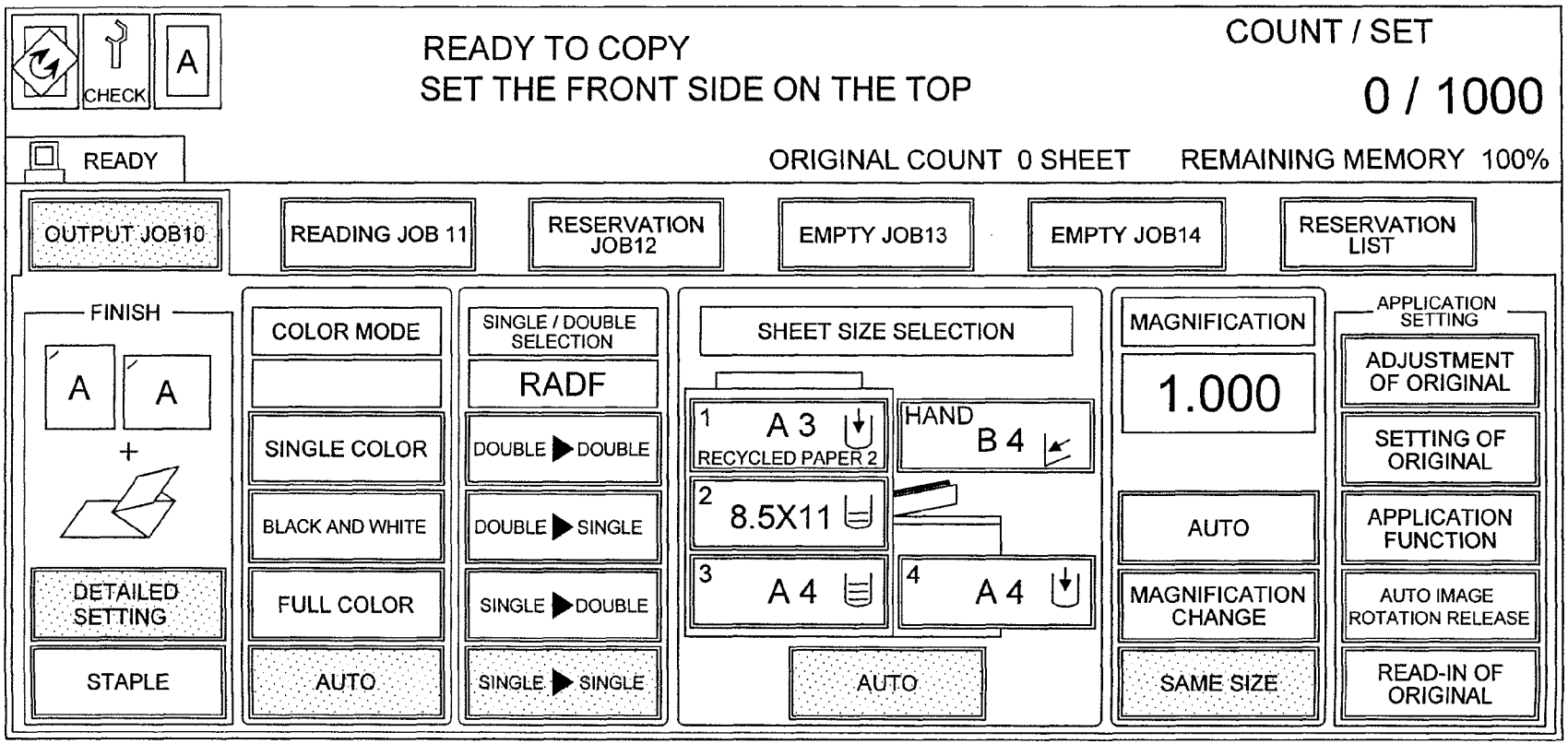
FIG. 2 is a drawing representing an example of the basic copy screen indicated on the display section of the image forming apparatus.

FIG. 2 shows the basic copy screen displayed on the display section 141. The basic copy screen in FIG. 2 shows that the printing job of the current JOB 10 is being outputted, JOB 11 and JOB 12 are registered as reserved jobs (reserved copying), and the document corresponding to the JOB 11 to be executed after the JOB 10 is being read.

The image memory 15 temporarily stores the image data having been scanned by the image reading section 11 and having been processed by the image processing section 12.

The storing section 16 has an HD (Hard Disk) or a non-volatile semiconductor memory, and stores varieties of control programs for controlling various sections of the image forming apparatus 1 and the data used with these programs. Further, the storing section 16 stores the printing jobs received from the operation section 142 or an external apparatus (such as a PC) connected with the communication network, in order of reception of these jobs. The storing section 16 also stores the suspended state retention time data inputted by the setting operation on the operation section 142.

The timing section 17 measures the suspended state retention time stored in the storing section 16, according to the control signal from the control section 10. After the lapse of the suspended state retention time, the timing section 17 outputs a signal to the control section 10 to indicate that the measuring operation has finished. The setting of the suspended state retention time can be modified by the operation of the operation section 142.

The communication control section 18 controls the communication with an external apparatus connected to a communication network such as a LAN (Local Area Network).

The following describes the operation of Embodiment 1.

Figure 3:
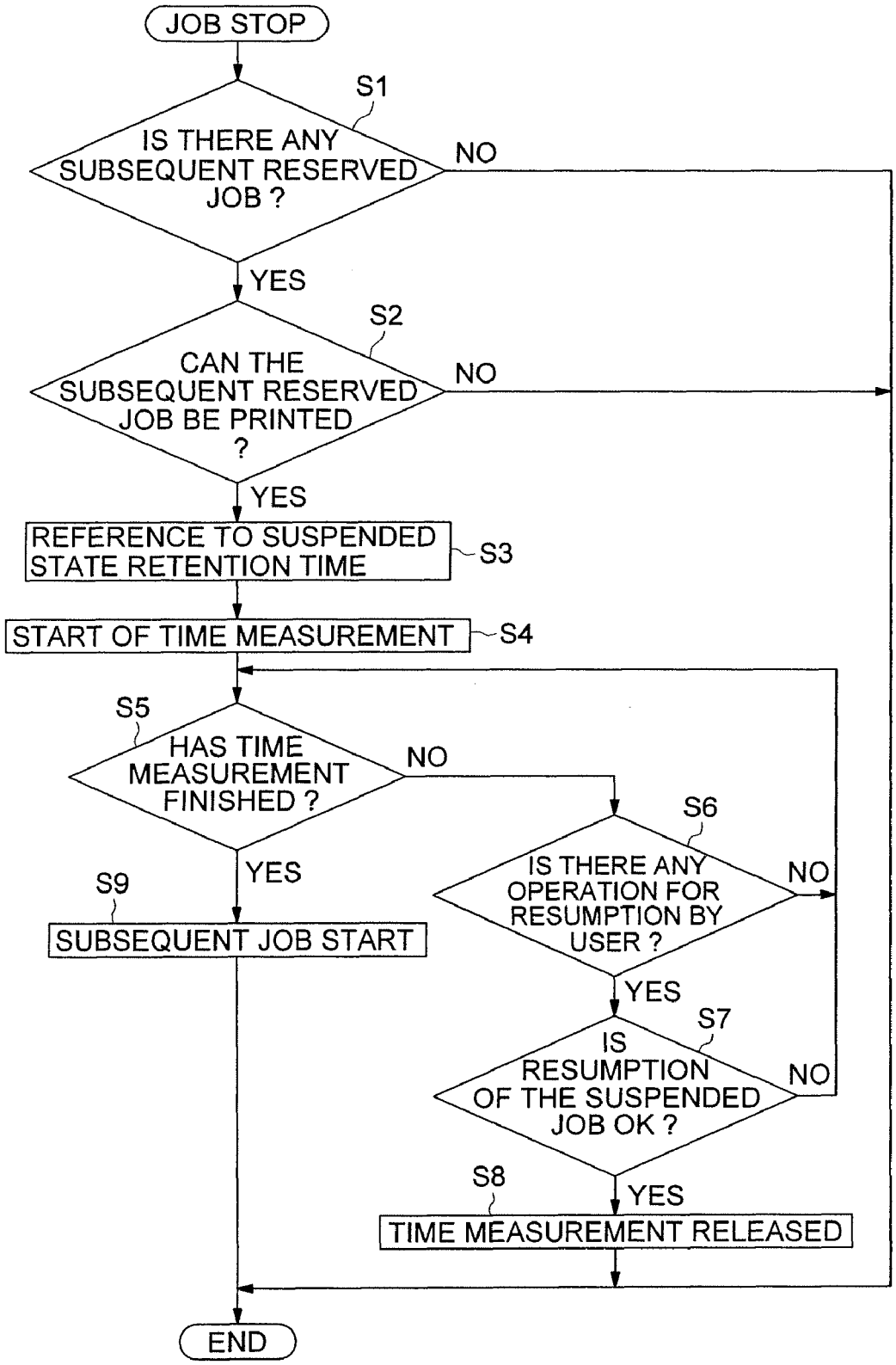
FIG. 3 is a flowchart showing the printing process of reserved job executed in the image forming apparatus as Embodiment 1 of the present invention.

Referring to the flowchart in FIG. 3, the following shows the printing process of reserved job to be applied in the image forming apparatus 1 of Embodiment 1, when the printing job during output operation has been suspended for some reason.

When the printing job during output operation has been suspended, a decision step is taken to determine if any subsequent reserved job is present or not (Steps S1). If it has been determined in Step S1 that there is no subsequent reserved job (NO in Step S1), then the printing process of the present reserved job terminates.

If it has been determined in Step S1 that there is a subsequent reserved job (YES in Step S1), then a decision step is taken to determine whether or not the subsequent reserved job can be printed by the image forming apparatus (S2). Specifically, a decision is made to ensure if the subsequent job can be printed under the current conditions of such as the size of the sheets remaining in the image forming apparatus, the number of these sheets or the amount of the remaining toner. For example, if the printing job has been suspended due to the A4-sized sheet having run out, a check is made to know if there is any subsequent job that can be printed using the remaining B5-sized sheets. Alternatively, if the color toner has run out to suspend the printing job, a check is made to know if there is any subsequent job that can be printed using the monochromatic toner.

If it has been determined in Step S2 that there is no printable job subsequently reserved (NO in Step S2), the printing process of the present reserved job terminates.

If it has been determined in Step S2 that there is a printable job subsequently reserved (YES in Step S2), reference is made to the suspended state retention time stored in the storing section 16 (Step S3), and the timing section 17 starts to measure the suspended state retention time (Step S4).

If a user's instruction is given from the operation section 142 to resume the printing job having been suspended (YES in Step S6), before measurement of the suspended state retention time finishes (NO in Step S5), a decision step is taken to determine if the printing job being suspended can be restarted or not (Steps S7). This is to check that a cause for job suspension has been removed, and sheets and toner are sufficiently supplied, before executing the instruction from the operation section.

If it has been determined in Step S7 that the printing job having been suspended can be resumed (YES in Step S7), measurement of the suspended state retention time is released (Steps S8), and the printing job is resumed. Then the printing process of the reserved job terminates.

Measurement of the suspended state retention time continues if a user's instruction other than resumption of the suspended printing job is given from the operation section 142 (user's operation is not performed or the operation other than resumption instruction of the suspended printing job has been performed) (NO in Step S6), before the measurement of the suspended state retention time finishes (NO in Step S5). The measurement also continues if it has been determined that this printing job cannot be resumed (it has been determined that the cause for job suspension is not yet removed) (NO in Step S7).

If the printing job having been suspended is not resumed even after the lapse of the suspended state retention time in Step S5, (YES in Step S5), the order of the printing jobs is changed, and the subsequent printing job is started (Step S8). Then the printing process of the present reserved job terminates.

As described above, in the image forming apparatus 1 of Embodiment 1, if the printing job during output operation has been suspended for some reason and the printing job having been suspended is not resumed even after the lapse of the suspended state retention time, the order of the suspended printing job and the subsequent printing job is changed, and the subsequent printing job is executed first. This arrangement improves the operational efficiency in reserved job printing.

The suspended state retention time can be set as desired. This feature permits easy change of the methods of using the image forming apparatus 1. For example, the suspended state retention time can be set to a longer time so as to restrain of the order change of printing jobs, or the suspended state retention time can be reduced so as to give priority to the printing efficiency.

Embodiment 2

Figure 4:
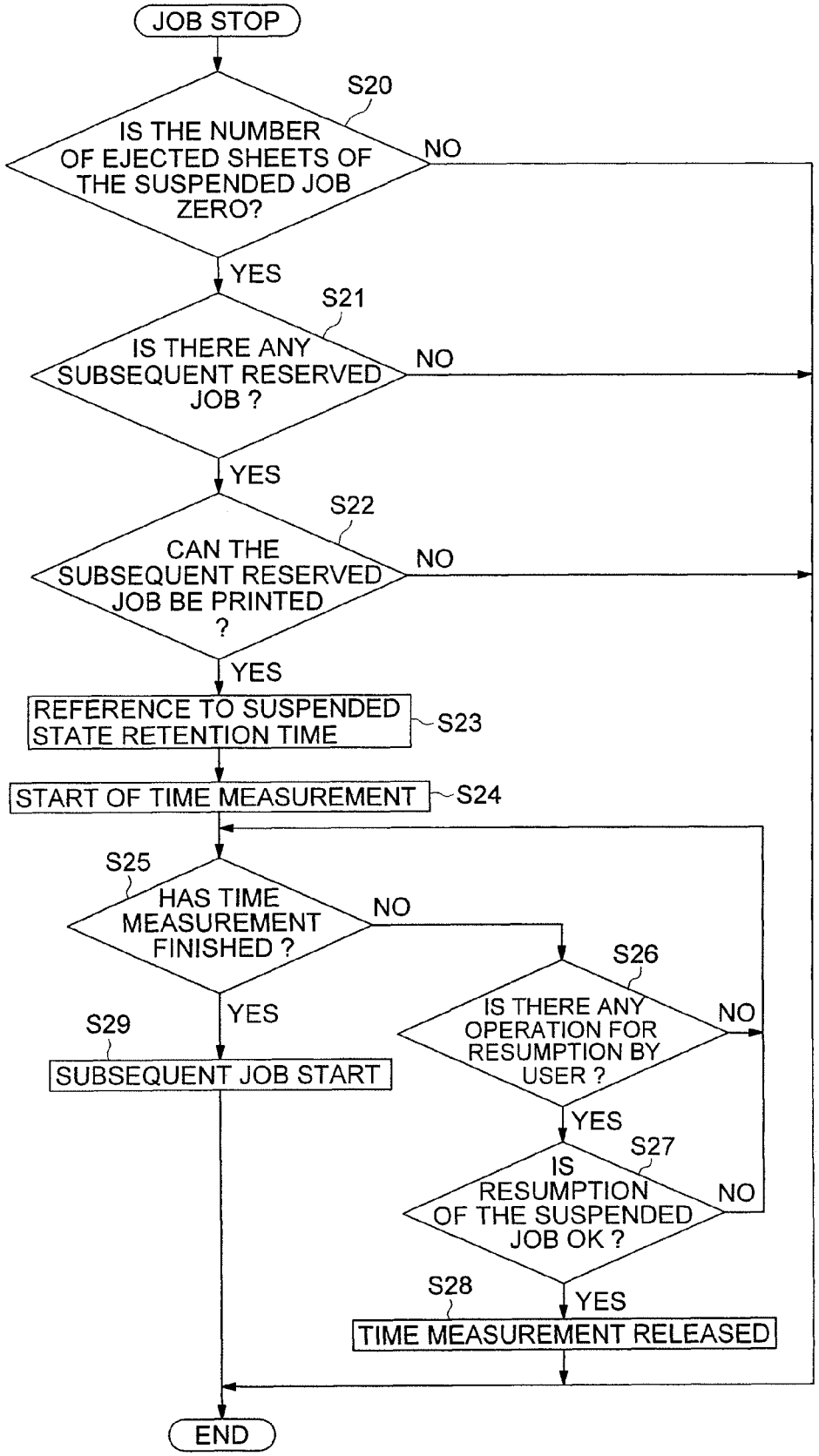
FIG. 4 is a flowchart showing the printing process of reserved job executed in the image forming apparatus as Embodiment 2 of the present invention.

Referring to FIG. 4, the following describes Embodiment 2 of the present invention.

In the first place, the structure in Embodiment 2 will be explained:

The structure of the major portions of the image forming apparatus as Embodiment 2 is the same as that shown in FIG. 1 of Embodiment 1, and their illustration will be omitted. Only the differences from the image forming apparatus 1 of Embodiment 1 will be described using the same reference numerals.

The control section 10 has a function of detecting the number of ejected sheets (the number of the outputted printing sheets) in the printing job during output operation. If the printing job during output operation has been suspended for some reason in the image forming body section 13, the timing section 17 starts measuring the suspended state retention time preset by the user, only when it has been detected that the number of ejected sheets in the suspended printing job is 0. If the suspended printing job is not resumed even after the lapse of the suspended state retention time, and there is a reserved printing job except for the printing job having been suspended, the order of the printing jobs is changed and the subsequent printing job is executed (FIG. 4).

This embodiment is intended to improve the operational convenience of the users when replacing the jobs due to suspension. Specifically, it is intended to prevent ejected sheets of different jobs from being mixed in the ejection tray as a result of the job replacement. Thus, if the sheets ejected in the suspended job are present in the tray, means are provided to ensure that no jobs are replaced and no subsequent printable job is started.

The following describes the operation in Embodiment 2.

Referring to the flowchart of FIG. 4, the following will explain the printing process of reserved job to be executed by the image forming apparatus 1 of Embodiment 2 when the printing job during output operation has been suspended for some reason.

When the printing job during output operation has been suspended, a decision step is taken to determine if the number of the sheets ejected in the suspended printing job is zero or not (Step S20). If it has been determined in Step S20 that the number of the sheets having been ejected in the suspended printing job is one or more, namely, that at least one sheet of printed paper has been outputted in that printing job (NO in Step 20), the printing process of the reserved job terminates.

If it has been determined in Step S20 that the number of the sheets having been ejected in the suspended printing job is zero (YES in Step 20), a check is made to ensure if there is any subsequent reserved job (Step S21). If it has been determined in Step S21 that there is no subsequent reserved job (NO in Step S21), the printing process of the present reserved job terminates.

If it has been determined in Step S21 that there is a subsequent reserved job (YES in Step S21), a check is made to ensure whether or not the subsequent reserved job can be printed by the image forming apparatus (S22). Specifically, a check is made to ensure if the subsequent reserved job can be printed or not, judging from the current size and number of sheets remaining in the image forming apparatus or the current conditions of the remaining toner. For example, if the printing job has been suspended due to the A4-sized sheet having run out, a check is made to know if there is any subsequent job that can be printed using the remaining B5-sized sheets. Alternatively, if the color toner has run out to suspend the printing job, a check is made to know if there is any subsequent job that can be printed using the monochromatic toner.

If it has been determined in Step S22 that there is no subsequent printable job (NO in Step S22), the printing process of the present reserved job terminates.

If it has been determined in Step S22 that there is a subsequent printable job (YES in Step S22), reference is made to the suspended state retention time stored in the storing section 16 (Step S23), and the timing section 17 starts to measure the suspended state retention time (Step S24).

If a user's instruction is given from the operation section 142 to resume the printing job having been suspended (YES in Step S26), before measurement of the suspended state retention time finishes (NO in Step S25), a decision step is taken to determine if the printing job being suspended can be restarted or not (Step S27).

If it has been determined in Step S27 that the printing job having been suspended can be resumed (YES in Step S27), measurement of the suspended state retention time is released (Step S28), and the printing job is resumed. Then the printing process of the reserved job terminates.

Measurement of the suspended state retention time continues if a user's instruction for other than resumption of the printing job having been suspended is given from the operation section 142 (user's operation is not performed or the operation for other than resumption of the printing job having been suspended has been performed) (NO in Step S26), before the measurement of the suspended state retention time finished (NO in Step S25). Measurement of the suspended state retention time also continues if it has been determined that this printing job cannot be resumed (it has been determined that the cause for job suspension is not yet removed) (NO in Step S27).

If the printing job having been suspended is not resumed even after the lapse of the suspended state retention time in Step S25 (YES in Step S25), the order of the printing jobs is changed, and the subsequent printing job is started (Step S29). Then the printing process of the present reserved job terminates.

As described above, in the image forming apparatus 1 of Embodiment 2, if the printing job during output operation has been suspended for some reason, and no sheet of printing paper has been outputted in the suspended printing job, and further the printing job having been suspended is not resumed even after the lapse of the preset suspended state retention time, the order of the printing job having been suspended and the subsequent printing job is changed, and the subsequent printing job is executed. This arrangement improves the operation efficiency in reserved job printing, and prevents sheets of paper of different jobs from being mixed on the ejection tray, thereby enhancing the operational convenience of the user.

Only when the number of ejected sheets in the suspended printing job is 0, printing jobs are replaced. This arrangement eliminates the need of setting complicated conditions when there is a sheet outputted in the finisher (not illustrated) inside the image forming apparatus 1 or the outputting of the sheets is not yet completed. Thus, this arrangement ensures more efficient operation of the image forming apparatus 1.

In Embodiment 2, the suspended state retention time can be set as desired. This feature permits easy change of the methods of using the image forming apparatus 1. For example, the suspended state retention time can be set to a longer time so as to restrain the change of the order of printing jobs, or the suspended state retention time can be reduced so as to give priority to the printing efficiency.

Embodiment 3

Figure 5:
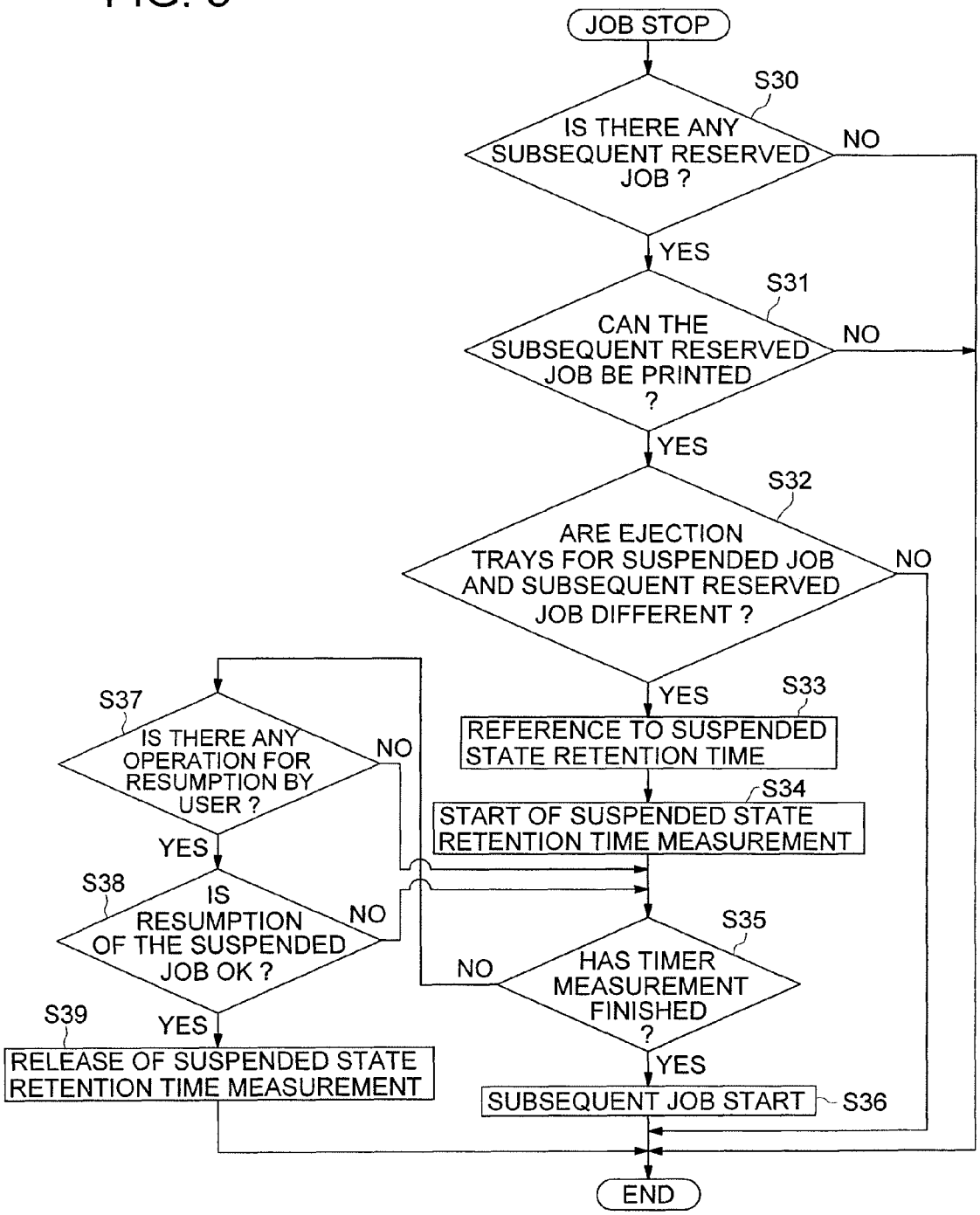
FIG. 5 is a flowchart showing the printing process of reserved job executed in the image forming apparatus as Embodiment 3 of the present invention.

Referring to FIG. 5, the following describes Embodiment 3 of the present invention.

The major portions of Embodiment 3 are the same as those of Embodiments 1 and 2, except that the image forming apparatus of the present embodiment has a plurality of ejection trays.

The control section 10 has a function of detecting the destination of ejection (tray) of the suspended printing job and the destination of ejection (tray) designated by the subsequent printable job. When the printing job during output operation in the image forming body section 13 has been suspended for some reason, the timing section 17 starts to measure the suspended state retention time preset by the user. If the printing job having been suspended is not restarted after the lapse of the suspended state retention time, and there is a reserved printing job other than the printing job having been suspended, and further the destinations to which the sheets of these two jobs are ejected are different, the order of the printing jobs are changed, and the subsequent printing job is executed (FIG. 5).

The present embodiment is intended to improve the operational convenience of the user when replacing the jobs subsequent to suspension. Specifically, if the destination to which the sheets of the suspended job are ejected is the same as the one to which the sheets of the subsequent printable job are ejected, the subsequent printable job is not executed. This arrangement prevents ejected sheets in different jobs from being mixed in the ejection tray.

The following describes the operation of Embodiment 3.

Referring to the flowchart of FIG. 5, the following describes the printing process of reserved job to be carried out in the image forming apparatus 1 of Embodiment 3, when the printing job during output operation has been suspended for some reason.

If the printing job during output operation has been suspended, a decision step is taken to determine if any subsequent reserved job is present or not (Step S30). If it has been determined in Step S30 that there is no subsequent reserved job (NO in Step S30), then the printing process of the present reserved job terminates.

If it has been determined in Step S30 that there is a subsequent reserved job (YES in Step S30), then a decision step is taken to determine whether or not the subsequent reserved job can be printed by the image forming apparatus (S31). The details are the same as those of Embodiments 1 and 2.

If it has been determined in Step S31 that there is no subsequent printable reserved job (NO in Step S31), the printing process of the present reserved job terminates.

If it has been determined in Step S31 that there is a subsequent reserved job (YES in Step S31), comparison is made to ensure if the sheet ejection tray of the suspended job is different from that of the reserved printable job or not.

If it has been determined in Step S32 that the sheet ejection tray of the suspended job is the same as that of the reserved printable job (NO in Step S32), then the printing process of the present reserved job terminates.

If it has been determined in Step S32 that the sheet ejection tray of the suspended job is different from that of the reserved printable job (YES in Step S32), reference is made to the suspended state retention time stored in the storing section 16 (Step S33), and the timing section 17 starts to measure the suspended state retention time (Step S34).

If a user's instruction is given from the operation section 142 to resume the printing job having been suspended (YES in Step S37), before measurement of the suspended state retention time finishes (NO in Step S35), a decision step is taken to determine if the printing job being suspended can be restarted or not (Step S38).

If it has been determined in Step S38 that the printing job having been suspended can be resumed (YES in Step S38), measurement of the suspended state retention time is released (Step S39), and the printing job is resumed. Then the printing process of the reserved job terminates.

Measurement of the suspended state retention time continues if a user's instruction for other than resumption of the printing job having been suspended is given from the operation section 142 (NO in Step S6), before the measurement of the suspended state retention time finishes (NO in Step S35). The measurement also continues if it has been determined that this printing job cannot be resumed (NO in Step S7).

If the printing job having been suspended is not resumed even after the lapse of the suspended state retention time in Step S35 (YES in Step S35), the order of the printing jobs is changed, and the subsequent printing job is started (Steps S36). Then the printing process of the present reserved job terminates.

In this embodiment, the flow is configured in such a way that the printing process of the present reserved job terminates if the same ejection tray is used. It is also possible to arrange such a configuration that, similarly to the Step S20 and subsequent steps of Embodiment 2, processing is carried out in response to the number of the sheets remaining in the tray resulting from the job suspension, without the processing being terminated.

As described above, in the image forming apparatus 1 of Embodiment 3 if the printing job during output operation has been suspended for some reason, and no sheet of printing paper has been outputted in the suspended printing job, and further the printing job having been suspended is not resumed even after the lapse of the suspended state retention time, the order of the printing job having been suspended and the subsequent printing job is changed, and the subsequent printing job is executed. This arrangement improves the operational efficiency in reserved job printing, and prevents sheets of paper of different jobs from being mixed on the ejection tray, thereby enhancing the operational convenience of the user.

According to the present invention, when the printing job during output operation has been suspended for some reason and the suspended printing job is not restarted after the lapse of the preset suspended state retention time, the order of the printing job being suspended and the subsequent printing job is changed, and the subsequent printing job is started. This arrangement improves the efficiency in reserved job printing operations.

Especially, only when no sheet printed by the suspended printing job is not outputted, the aforementioned replacement of the printing jobs is performed. This arrangement eliminates the need of the complicated condition setting resulting from the suspended printing job subsequent to outputting of a printed sheet. This procedure ensures more effective operation of the image forming apparatus.

It is to be noted that various changes and modifications will be apparent to those skilled in the art. Therefore, unless such changes and modifications depart from the scope of the present invention, they should be construed as being included therein.

What is claimed is:

1. An image forming apparatus in which a plurality of printing jobs can be reserved comprising:

a setting device to set suspended state retention time for which a suspended state of a suspended printing job is retained;

a timing device to make measurement of the suspended state retention time set by the setting device;

a controlling device to make determination whether the suspended printing job can be resumed and whether a subsequent printing job which can be printed exists when a printing job during output operation has been suspended, and to control a printing process of the image forming apparatus based on results of the determination and the measurement by the timing device;

a sheet number detecting device for detecting number of printed sheets outputted by the suspended printing job when a printing job during output operation has been suspended; and a plurality of sheet ejecting sections to output printed sheets, wherein when the controlling device determines that the suspended printing job cannot be resumed within the suspended state retention time and that a subsequent printing job which can be printed exists, the controlling device conducts detection of a sheet ejecting section which has been designated for the subsequent printing job and a sheet ejecting section which has been designated for the suspended printing job, compares the detected sheet ejecting sections and when the sheet ejecting section for the subsequent printing job and the sheet ejecting section for the suspended printing job are different, the controlling device changes executing order of the subsequent printing job and the suspended printing job, and executes the subsequent printing job, and when the sheet ejecting section for the subsequent printing job and the sheet ejecting section for the suspended printing job are identical, if it is detected by the sheet number detecting device that no printed sheet has been outputted by the suspended printing job, the controlling device changes executing order of the subsequent printing job and the suspended printing job, and executes the subsequent printing job and if it is detected by the sheet number detecting device that one or more printed sheets have been outputted by the suspended printing job, the controlling device does not change executing order of the subsequent printing job and the suspended printing job.

* * * * *